US010627781B2

(12) United States Patent
Ichimura et al.

(10) Patent No.: US 10,627,781 B2
(45) Date of Patent: Apr. 21, 2020

(54) SWITCH DEVICE AND TIMEPIECE

(71) Applicant: CASIO COMPUTER CO., LTD., Tokyo (JP)

(72) Inventors: Tatsumi Ichimura, Ome (JP); Hajime Iguchi, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 188 days.

(21) Appl. No.: 15/911,395

(22) Filed: Mar. 5, 2018

(65) Prior Publication Data

US 2018/0275608 A1 Sep. 27, 2018

(30) Foreign Application Priority Data

Mar. 27, 2017 (JP) ..... 2017-061528

(51) Int. Cl.
*G04B 37/10* (2006.01)
*G04B 37/08* (2006.01)
*G04C 3/00* (2006.01)

(52) U.S. Cl.
CPC ..... *G04B 37/106* (2013.01); *G04B 37/08* (2013.01); *G04C 3/001* (2013.01)

(58) Field of Classification Search
CPC ..... G04B 37/106; G04B 37/08; G04B 37/02; G04B 37/04; G04C 3/001; H01H 13/14; H01H 13/06; H01H 2223/002; H01H 2300/016; H01H 2221/08
USPC ..... 368/291
See application file for complete search history.

(56) References Cited

U.S. PATENT DOCUMENTS 2,507,974 A * 5/1950 Georges ..... G04B 37/10 368/288
8,303,168 B2 * 11/2012 Takasawa ..... G04G 17/08 368/280
8,419,269 B2 * 4/2013 Hiranuma ..... G04B 37/08 368/291
2009/0147630 A1 6/2009 Clerc et al.
2016/0093453 A1 * 3/2016 Sakurazawa ..... H01H 13/14 368/321

FOREIGN PATENT DOCUMENTS

JP 2009-070657 A 4/2009
JP 2009-133859 A 6/2009

OTHER PUBLICATIONS

The First Office Action dated Apr. 18, 2019 received in Chinese Patent Application No. CN 201810199385.7 together with an English language translation.

* cited by examiner

*Primary Examiner* — Edwin A. Leon
(74) *Attorney, Agent, or Firm* — Scully Scott Murphy & Presser

(57) ABSTRACT

A switch device including a case provided with a through hole, an operation member including a shaft section which is inserted into the through hole of the case and a head section which is provided on an outer end portion of the shaft section and arranged outside the case, an elastic body which is arranged between outer surface of the case and inner surface of the head section of the operation member opposing the outer surface of the case, and forces the head section outward from the case by an elastic force of a material of the elastic body, and a slipping section which provides slipperiness in a rotational direction to the elastic body and the head section.

13 Claims, 7 Drawing Sheets

SWITCH DEVICE AND TIMEPIECE

CROSS-REFERENCE TO RELATED APPLICATION

This application is based upon and claims the benefit of priority from the prior Japanese Patent Application No. 2017-061528, filed Mar. 27, 2017, the entire contents of which are incorporated herein by reference.

BACKGROUND OF THE INVENTION

1. Field of the Invention

The present invention relates to a switch device that is used in electronic devices such as wristwatches, mobile phones, and personal digital assistants, and a timepiece having the same.

2. Description of the Related Art

For example, a switch device for a wristwatch is known in which a mounting pipe is fitted into a fitting hole of a wristwatch case, a shaft portion of a button member is slidably inserted into the mounting pipe, the shaft portion of the button member protruding from the mounting pipe and the head of the shaft portion formed on its outer end are covered with a waterproof sheet, and the waterproof sheet is attached to the outer surface of the wristwatch case via a fixing member so as to achieve water-proofness, as described in Japanese Patent Application Laid-Open (Kokai) Publication No. 2009-133859.

This type of switch device having the waterproof sheet made of a soft synthetic resin such as urethane resin or silicone resin is structured such that, when the button member is pressed, the waterproof sheet deforms elastically in response to this press operation, and the elastic deformation of the waterproof sheet causes the button member to slide and come in contact with a switch contact inside the wristwatch case, which results in a switching operation.

However, in this switch device for a wristwatch where water-proofness and mud-proofness are achieved by the waterproof sheet, the button member can be operated only by its head portion being operated from outside the waterproof. As a result of this structure, the operability of the button member is poor.

SUMMARY OF THE INVENTION

An object of the present invention is to provide a switch device that can achieve excellent operability while maintaining water-proofness and mud-proofness, and a timepiece having the same.

In accordance with one aspect of the present invention, there is provided a switch device comprising: a case provided with a through hole; an operation member including a shaft section which is inserted into the through hole of the case and a head section which is provided on an outer end portion of the shaft section and arranged outside the case; an elastic body which is arranged between outer surface of the case and inner surface of the head section of the operation member opposing the outer surface of the case, and forces the head section outward from the case by an elastic force of a material of the elastic body; and a slipping section which provides slipperiness in a rotational direction to the elastic body and the head section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

A first embodiment where the present invention has been applied in a wristwatch will hereinafter be described with reference to FIG. 1 to FIG. 4A and FIG. 4B.

Figure 1:
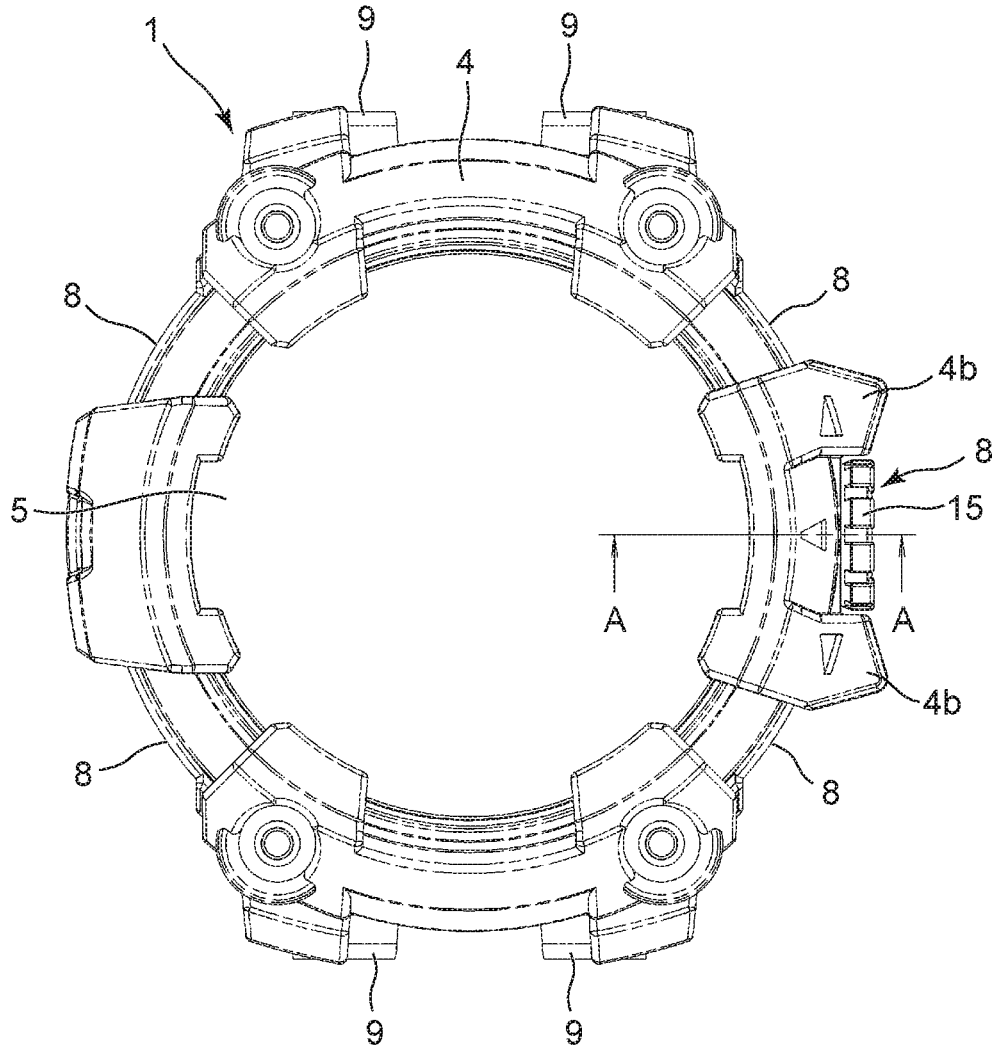
FIG. 1 is an enlarged front view of a first embodiment in which the present invention has been applied in a wristwatch.
Figure 2:
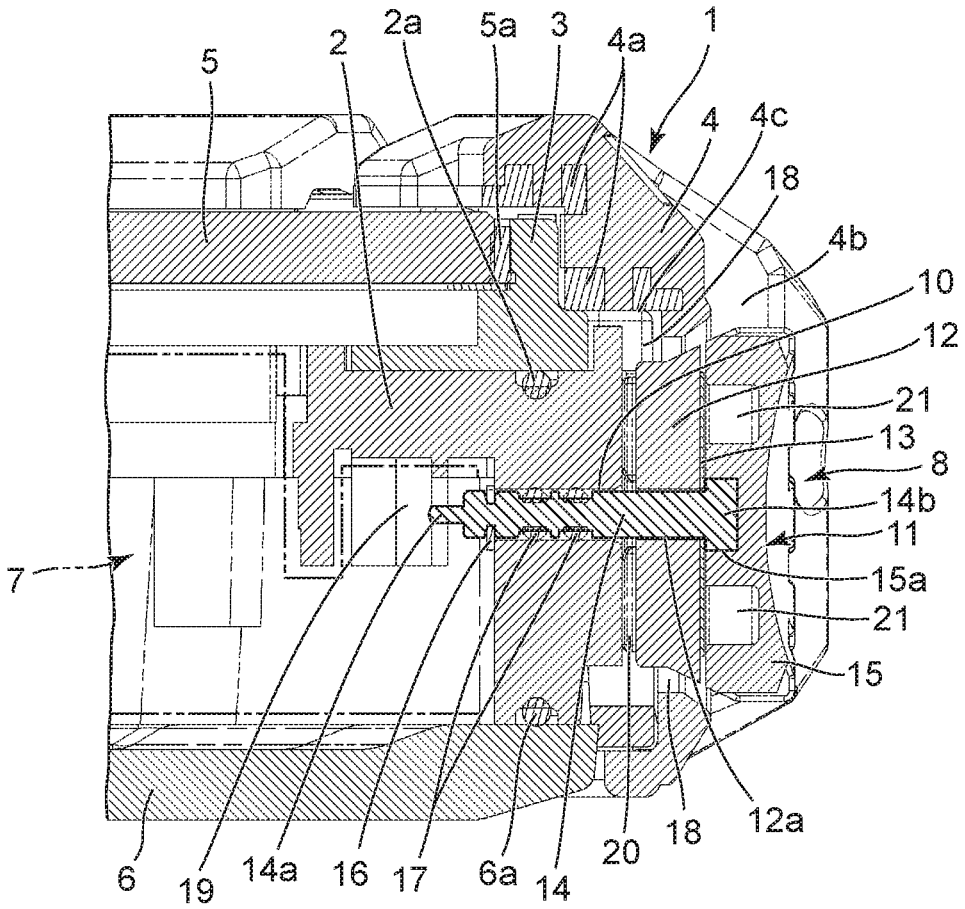
FIG. 2 is an enlarged sectional view of the main portion of the wristwatch taken along line A-A in FIG. 1.
Figure 3:
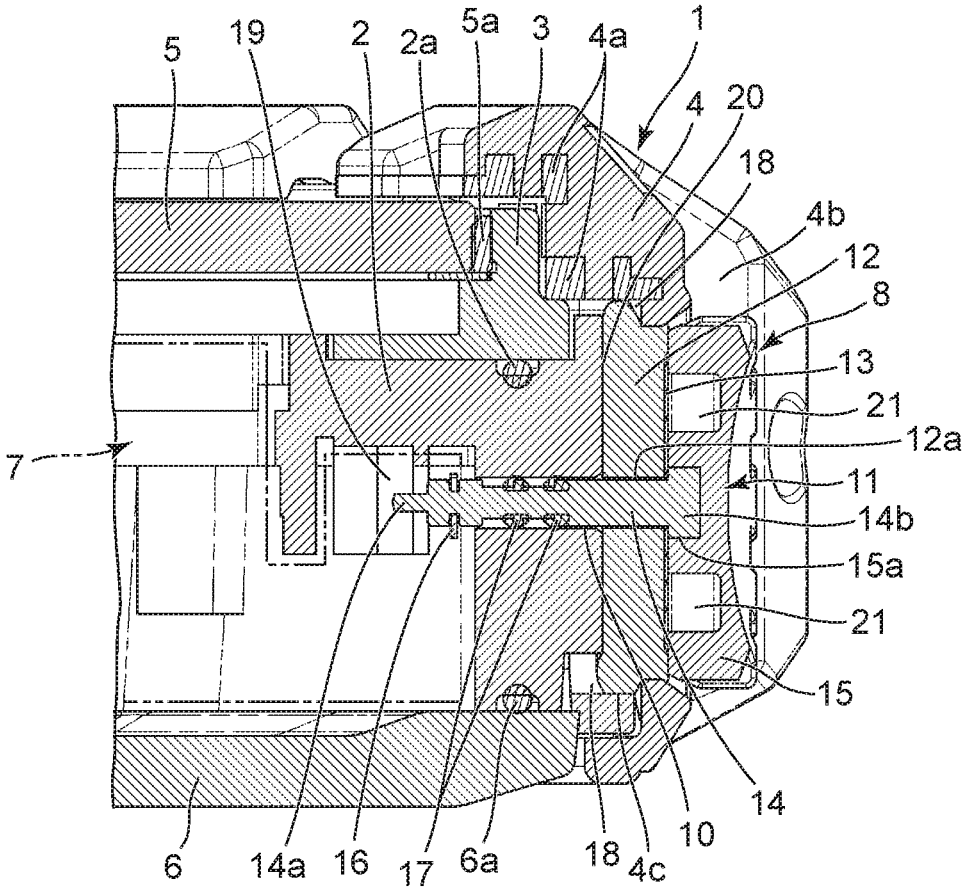
FIG. 3 is an enlarged sectional view of the main portion, in which an operation member has been operated in a switch device shown in FIG. 2.
Figure 4A:
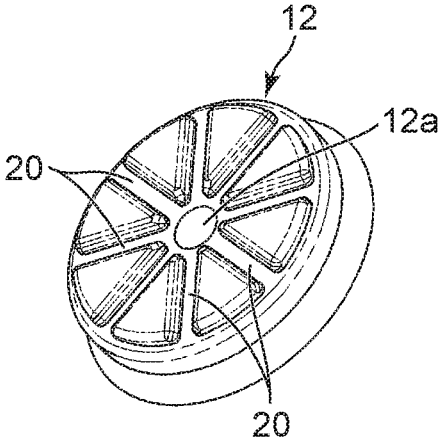
FIG. 4A is an enlarged perspective view of an elastic body in the switch device of FIG. 2 when viewed from its inner surface side.
Figure 4B:
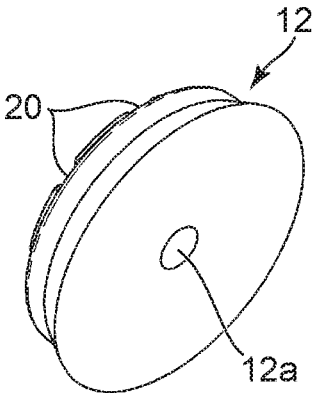
FIG. 4B is an enlarged perspective view of the elastic body in the switch device of FIG. 2 when viewed from its outer surface side.

This wristwatch includes a wristwatch case 1, as shown in FIG. 1 to FIG. 3. The wristwatch case 1 includes a first case 2, a second case 3 provided on the first case 2 via a waterproof ring 2*a*, and an exterior member 4 provided around the outer peripheries the first case 2 and the second case 3 so as to cover them.

The main bodies of the first and second cases 2 and 3 are formed of a hard synthetic resin or metal, as shown in FIG. 1 to FIG. 3. The exterior member 4 is formed of a soft synthetic resin such as urethane resin, and has a reinforcing member 4*a* embedded in its inner peripheral surface. To an upper opening portion of this wristwatch case 1, that is, an upper opening portion of the second case 3, a timepiece glass 5 is attached via a packing 5*a*. Also, to a lower portion of this wristwatch case 1, that is, a lower portion of the first case 2, a rear cover 6 is attached via a waterproof ring 6*a*.

Inside this wristwatch case 1, or in other words, inside the first and second cases 2 and 3, a timepiece module 7 is arranged, as shown in FIG. 2 and FIG. 3. This timepiece module 7 includes various types of components required for a timepiece function, such as a timepiece movement (not shown) which indicates the time by moving hands, a display section which displays information such as the time, a switch element 19 described below, and a circuit section which electrically drives the timepiece movement, the display section, and the switch element 19.

Also, on the six o'clock side and the twelve o'clock side of this wristwatch case 1, band attachment sections 9 are respectively provided, as shown in FIG. 1. Further, on the 2 o'clock side, the 3 o'clock side, the 4 o'clock side, the 8 o'clock side, and the 10 o'clock side of this wristwatch case 1, switch devices 8 are respectively provided.

Among these switch devices 8, for example, the switch device 8 positioned on the three o'clock side includes an operation member 11 which is inserted into a through hole 10 provided in the first case 2 in the wristwatch case 1, an elastic body 12 which forces this operation member 11 outward from the first case 2, and a slipping sheet 13 which causes the elastic body 12 and the operation member 11 to have sliding properties in their rotational direction, as shown in FIG. 2 and FIG. 3.

The operation member 11 includes a shaft section 14 which is inserted into the through hole 10 in the first case 2 such that it is slidable and rotatable in its axial direction and a head section 15 which is provided on an outer end portion of this shaft section 14 and slidably and rotatably arranged between a pair of protection projection sections 4*b* provided on an outer peripheral portion of the exterior member 4, as shown in FIG. 2 and FIG. 3.

In this embodiment, the shaft section 14 of the operation member 11 is formed of a metal such as stainless or titanium and has a substantially round bar shape whose outer diameter is substantially the same as the inner diameter of the through hole 10, as shown in FIG. 2 and FIG. 3. An inner end portion of the shaft section 14 inside the first case 2 is formed as a small-diameter section 14*a* and an outer end portion thereof outside the first case 2 is formed as a large-diameter section 14*b*.

Also, this shaft section 14 of the operation member 11 is formed such its axial directional length is larger than the axial directional length of the through hole 10 in the first case 2, as shown in FIG. 2 and FIG. 3. As a result, this shaft section 14 is structured to be arranged between the pair of protection projection sections 4*b* on the exterior member 4 with the small-diameter section 14*a* of the inner end portion protruding into the first case 2 and the large-diameter section 14*b* of the outer end portion protruding outward from the first case 2.

Also, to the small-diameter section 14*a* at the inner end portion of the shaft section 14 of the operation member 11 protruding into the first case 2, a retaining member 16 such as an E ring is attached, as shown in FIG. 2 and FIG. 3. As a result, by the retaining member 16 separably coming in contact with the inner surface of the first case 2, the shaft section 14 does not slip out of the first case 2.

Further, on the outer peripheral surface of the shaft section 14 of the operation member 11, a plurality of packing members 17 is provided such that each of them has an annular shape, as shown in FIG. 2 and FIG. 3. Each of the plurality of packing members 17 is structured to achieve waterproof between the outer peripheral surface of the shaft section 14 and the inner peripheral surface of the through hole 10 by its outer peripheral portion movably coming in pressure contact with the inner peripheral surface of the through hole 10.

On the other hand, the head section 15 of the operation member 11 is formed of a metal such as stainless or titanium or a hard synthetic resin and has a substantially circular disk shape, as shown in FIG. 2 and FIG. 3. This head section 15, which has an mounting hole 15*a* provided in the center of its inner surface, is structured to be attached with the large-diameter section 14*b* of the shaft section 14 being inserted into the mounting hole 15*a*.

Here, in a case where the head section 15 of the operation member 11 is made of metal, the head section 15 is attached to the large-diameter section 14*b* of the shaft section 14 by welding such as laser welding, with the large-diameter section 14*b* of the shaft section 14 being inserted into the mounting hole 15*a*. Also, in a case where the head section 15 of the operation member 11 is made of synthetic resin, the head section 15 is attached to the large-diameter section 14*b* of the shaft section 14 by the large-diameter section 14*b* of the shaft section 14 being attached to the mounting hole 15*a* with an adhesive.

This head section 15 of the operation member 11 is formed such that its outer diameter is sufficiently larger than the outer diameter of the shaft section 14 and is slightly smaller than the length (the height) of the first case 2 in the vertical direction, as shown in FIG. 2 and FIG. 3. Also, this head section 15 is formed such that its axial directional length is slightly smaller than the length (the thickness) of the pair of protection projection sections 4*b* on the exterior member 4 in the axial direction of the through hole 10 in the first case 2. As a result, this head section 15 is structured to be slidably and rotatably arranged between the pair of protection projection sections 4*b* on the exterior member 4.

The elastic body 12, which forces the operation member 11 outward from the wristwatch case 1, is formed of an elastic material such as an elastomer that is silicone resin or urethane resin, and has a circular disk shape, as shown in FIG. 2 to FIG. 4A and FIG. 4B. This elastic body 12 is formed to have substantially the same size as that of the head section 15 of the operation member 11, and is arranged between the outer surface of the first case 2 and the inner surface of the head section 15 opposing the outer surface of the first case 2.

More specifically, this elastic body 12 has the insertion hole 12*a* provided at its center, into which the shaft section 14 of the operation member 11 is inserted, as shown in FIG. 2 to FIG. 4A and FIG. 4B. This insertion hole 12*a* is formed such that its inner diameter is larger than the outer diameter of the shaft section 14. As a result, the elastic body 12 is structured to force the head section 15 of the operation member 11 outward from the wristwatch case 1 by the elastic force of its material itself.

In this embodiment, the elastic body 12 is structured such that it forces the head section 15 of the operation member 11 outward from the wristwatch case 1 by an elastic force generated by it expanding to a stable shape in a natural state, and thereby arranges the head section 15 of the operation member 11 between the pair of protection projection sections 4*b* on the exterior member 4 and causes the retaining member 16 attached to the small-diameter section 14*a* of the shaft section 14 to come in contact with the inner surface of the first case 2, as shown in FIG. 2 to FIG. 4A and FIG. 4B.

As a result, the elastic body 12 is structured such that, by the retaining member 16 attached to the small-diameter section 14*a* of the shaft section 14 coming in contact with the inner surface of the first case 2 by an elastic force generated by the elastic body 12 expanding to a stable shape in a natural state, the inner surface of the elastic body 12 on the first case 2 side comes in elastic contact with the outer surface of the first case 2, whereby waterproof between the outer surface of the first case 2 and the inner surface of the elastic body 12 opposing the outer surface of the first case 2 is achieved, as shown in FIG. 2 to FIG. 4A and FIG. 4B.

Also, this elastic body 12 is structured such that, when the head section 15 of the operation member 11 is pressed toward the first case 2 against the elastic force of the material itself of the elastic body 12, the elastic body 12 is compressed between the head section 15 and the first case 2, whereby the shaft section 14 of the operation member 11 is slid in the axial direction so as to cause the small-diameter section 14*a* to protrude into the first case 2 and the leading end of this small-diameter section 14*a* to be pressed into the switch element 19 described below, as shown in FIG. 2 to FIG. 4A and FIG. 4B.

In this embodiment, the external member 4 is provided with a clearance section 18 for providing a space for the elastic deformation of the elastic body 12 when the elastic body 12 is elastically deformed by being pressed by the head section 15 of the operation member 11, as shown in FIG. 2 and FIG. 3. That is, in the exterior member 4, a hole section 4*c* where the elastic body 12 is arranged is formed such that its outer diameter is larger than the outer diameter of the elastic body 12.

The clearance section 18 is a clearance gap provided between the inner peripheral surface of the hole 4*c* of the exterior member 4 and the outer peripheral surface of the elastic body 12, as shown in FIG. 2 and FIG. 3. This clearance section 18 is structured to provide a space for the elastic deformation of the elastic body 12 when the elastic body 12 is compressed by being pressed by the head section 15 of the operation member 11 and elastically deformed to expand toward its outer periphery, whereby the elastic body 12 is smoothly elastically deformed.

Also, on the inner surface of the elastic body 12 opposing the outer surface of the first case 2, a plurality of pressure adjustment grooves 20 are provided in a radial shape, as shown in FIG. 2 to FIG. 4A and FIG. 4B. These pressure adjustment grooves 20 are structured such that, when pressure such as hydraulic pressure or atmospheric pressure outside the wristwatch case 1 is applied to the head section 15 of the operation member 11, a fluid such as water or air outside the wristwatch case 1 flows thereinto via the clearance section 18.

As a result, the plurality of pressure adjustment grooves 20 are structured to keep a pressure between the outer surface of the first case 2 and the inner surface of the elastic body 12 opposing the outer surface of the first case 2 at the same level as a pressure outside the wristwatch case 1 when a fluid such as water or air outside the wristwatch case 1 flows into the pressure adjustment grooves 20, whereby the operation member 11 is not unintentionally operated by the outside pressure such as hydraulic pressure or atmospheric pressure, as shown in FIG. 2 to FIG. 4A and FIG. 4B.

Also, the plurality of pressure adjustment grooves 20 are structured such that, when the elastic body 12 is elastically deformed by being pressed by the head section 15 of the operation member 11, the pressure adjustment grooves 20 are elastically and flexurally deformed along with the elastic deformation of the elastic body 12, whereby a fluid such as water or air flown thereinto is ejected to the clearance section 18, as shown in FIG. 2 to FIG. 4A and FIG. 4B.

On the other hand, the slipping sheet 13 is arranged between the elastic body 12 and the head section 15 of the operation member 11, as shown in FIG. 2 and FIG. 3. This slipping sheet 13 is formed of a synthetic resin having slipperiness such as fluorine-based resin or polyamide-based resin. Note that, while the slipping sheet 13 may be formed of a synthetic resin having slipperiness, it may be provided by a synthetic resin with slipperiness being provided on the front and rear surfaces of a flat plate formed of metal or a hard resin.

This slipping sheet 13 is structured to provide slipperiness in a rotational direction to the elastic body 12 and the head section 15 by preventing contact between the elastic body 12 and the head section 15 of the operation member 11, as shown in FIG. 2 and FIG. 3. That is, the slipping sheet 13 is structured so that the head section 15 of the operation member 11 is easily rotated with respect to the elastic body 12 when the head section 15 is rotated with the elastic body 12 being elastically deformed by being pressed by the head section 15.

In this embodiment, a friction reduction section 21, which reduces a frictional resistance between the slipping sheet 13 and the head section 15, is provided on the inner surface of the head section 15 of the operation member 11 opposing the elastic body 12, as shown in FIG. 2 and FIG. 3. This friction reduction section 21 is an annular groove section provided on the inner surface of the head section 15 opposing the slipping sheet 13, and is structured to reduce the frictional resistance of the head section 15 with respect to the slipping sheet 13 by reducing the contact area of the head section 15 with respect to the slipping sheet 13. Also, the slipping sheet 13 is formed to be so hard as not to enter the friction reduction section 21 when the elastic body 12 is elastically deformed by being pressed by the head section 15 of the operation member 11, and the annular groove section serving as the friction reduction section 21 is formed to have a size by which the slipping sheet 13 does not enter the groove section.

Also, the switch element 19 in the timepiece module 7 is structured to output a first switch signal by the leading end of the small-diameter section 14*a* of the shaft section 14 being pressed thereinto when the head section 15 is pressed against the elastic force of the elastic body 12 and the shaft section 14 of the operation member 11 is slid into the first case 2, and to output a second switch signal in response to the rotation of the head section 15, as shown in FIG. 2 and FIG. 3.

Next, the operation of the switch device 8 in the wristwatch is described.

When this switch device 8 is in a normal state, the head section 15 of the operation member 11 has been pulled outward from the wristwatch case 1 by the elastic force of the elastic body 12 expanding to a stable shape in a natural state, and positioned between the pair of protection projection sections 4*b* on the exterior member 4.

In this state, the retaining member 16 provided on the small-diameter section 14*a* of the shaft section 14 of the operation member 11 is in contact with the inner peripheral surface of the first case 2. As a result, the inner surface of the elastic body 12 opposing the outer surface of the first case 2 is in elastic contact with the outer surface of the first case 2, whereby waterproof between the outer surface of the first case 2 and the inner surface of the elastic body 12 is achieved. Here, the switch element 19 in the timepiece module 7 is in an off state by the leading end of the small-diameter section 14*a* of the shaft section 14 of the operation member 11.

In this state, when the head section 15 of the operation member 11 arranged between the pair of protection projection sections 4*b* on the exterior member 4 is pressed into the wristwatch case 1 against the elastic force of the elastic body 12, the inner surface of the head section 15 presses and compresses the elastic body 12 via the slipping sheet 13. Here, the elastic body 12 expands toward the outer periphery side according to its compressed state, and the expanded portion is released to the clearance section 18 in the exterior member 4, whereby the elastic body 12 is favorably compressed and deformed.

As a result, the shaft section 14 of the operation member 11 is slid inside the through hole 10 in the first case 2. Here, the plurality of packing members 17 provided on the outer periphery of the shaft section 14 are slid while coming in pressure contact with the inner peripheral surface of the through hole 10, so that waterproof between the outer peripheral surface of the shaft section 14 and the inner peripheral surface of the through hole 10 is achieved. In addition, the leading end of the small-diameter section 14*a* of the shaft section 14 is pressed into the switch element 19 in the timepiece module 7, and whereby the switch element 19 outputs a first switch signal.

Also, when the head section 15 of the operation member 11 is rotated, the shaft section 14 of the operation member 11 is rotated, and the small-diameter section 14*a* of the shaft section 14 is rotated inside the switch element 19 along with the rotation of the shaft section 14, whereby the switch element 19 outputs a second switch signal. Here, when the head section 15 of the operation member 11 is rotated while elastically deforming the elastic body 12, the inner surface of the head section 15 is rotated while coming in elastic contact with the slipping sheet 13, so that the head section 15 is smoothly rotated via the slipping sheet 13.

When the inner surface of the head section 15 of the operation member 11 is being rotated while coming in elastic contact with the slipping sheet 13, the friction reduction section 21 provided in the inner surface of the head section 15 reduces the frictional resistance of the head section 15 with respect to the slipping sheet 13. More specifically, this friction reduction section 21 is an annular groove section provided in the inner surface of the head section 15, so that the contact area of the head section 15 with respect to the slipping sheet 13 is reduced, and the frictional resistance of the head section 15 with respect to the slipping sheet 13 is reduced. As a result, the head section 15 is further smoothly rotated.

In the switch device 8 in the normal state, even when the head section 15 of the operation member 11 has been pulled outward from the wristwatch case 1 by the elastic force of the elastic body 12 expanding to a stable shape in a natural state and the inner surface of the elastic body 12 is in elastic contact with the outer surface of the first case 2, the plurality of pressure adjustment grooves 20 provided in a radial shape in the inner surface of the elastic body 12 opposing the outer surface of the first case 2 prevents the operation member 11 from being unintentionally operated.

That is, in the switch device 8 in the normal state, even when the inner surface of the elastic body 12 is in elastic contact with the outer surface of the first case 2, a fluid such as water or air outside the wristwatch case 1 flows into the plurality of pressure adjustment grooves 20 provided in the inner surface of the elastic body 12. Accordingly, by the fluid such as water or air flowed into the plurality of pressure adjustment grooves 20, a pressure between the outer surface of the first case 2 and the inner surface of the elastic body 12 can be kept at the same level as a pressure outside the wristwatch case 1. As a result, by the pressure such as hydraulic pressure or atmospheric pressure outside the wristwatch case 1, the elastic body 12 is prevented from being compressed and deformed, so that the operation member 11 is prevented from being unintentionally operated.

Here, even if a foreign substance such as mud or dust flows into the plurality of pressure adjustment grooves 20 together with a fluid such as water or air, the plurality of pressure adjustment grooves 20 are elastically and flexurally deformed when the head section 15 of the operation member 11 is pressed and the elastic body 12 is compressed and deformed, so that the foreign substance such as mud or dust flowed into the plurality of pressure adjustment grooves 20 together with the fluid such as water or air can be ejected to the clearance section 18, and mud-proofness and dust-proofness can be achieved.

As described above, the switch device 8 in the wristwatch achieves water-proofness and mud-proofness and improves operability by including the operation member 11 having the shaft section 14 which is inserted into the through hole 10 provided in the first case 2 in the wristwatch case 1 and the head section 15 which is provided on the outer end portion of the shaft section 14 and arranged outside the first case 2, the elastic body 12 which is arranged between the outer surface of the first case 2 and the head section 15 of the operation member 11 opposing the outer surface of the first case 2 and forces the head section 15 outward from the first case 2 by the elastic force of the material itself, and the slipping sheet 13 which provides a sliding property in a rotational direction to the elastic body 12 and the head section 15.

That is, in the switch device 8 in the wristwatch, the material itself of the elastic body 12 is elastically deformed without the elastic body 12 being affected by a foreign substance such as mud, whereby water-proofness and mud-proofness can be achieved. In addition, by the elastic force of the material itself of the elastic body 12 arranged between the outer surface of the first case 2 and the head section 15 of the operation member 11, the inner surface of the elastic body 12 comes in elastic contact with the outer surface of the first case 2, whereby water-proofness and mud-proofness between the outer surface of the first case 2 and the inner surface of the elastic body 12 can be achieved.

Also, in the switch device 8 in the wristwatch, the slipping sheet 13 for providing a sliding property in a rotational direction to the elastic body 12 and the head section 15 of the operation member 11 prevents the elastic body 12 and the head section 15 from coming in direct contact with each other and causes the head section 15 to be smoothly rotated with respect to the elastic body 12 even when the head section 15 is pressing and compressing the elastic body 12, whereby the operability of the operation member 11 can be improved.

Here, in the switch device 8, the shaft section 14 of the operation member 11 is inserted into the through hole 10 in the first case 2 in a manner to be slidable and rotatable in the axial direction. Accordingly, by the head section 15 of the operation member 11 being pressed to compress the elastic body 12, a switch operation of the switch element 19 in the wristwatch case 1 can be performed by the inner end portion of the shaft section 14 being pressed into the switch element 19. Also, by the rotation of the head section 15 as well, a switch operation of the switch element 19 can be performed in response to the rotation operation.

Also, in the switch device 8, the slipping sheet 13 for providing a sliding property in a rotational direction to the elastic body 12 and the head section 15 of the operation member 11 is interposed between the elastic body 12 and the head section 15. Accordingly, contact between the elastic body 12 and the head section 15 can be reliably prevented. In addition, when pressing and compressing the elastic body 12, the head section 15 can be brought into pressure contact with the slipping sheet 13 without projecting into the elastic body 12. Accordingly, by the slipping sheet 13, the head section 15 can be smoothly and favorably rotated with respect to the elastic body 12 even when compressing the elastic body 12.

Moreover, in the switch device 8, the elastic body 12 includes the clearance section 18 which provides a space for the elastic deformation of the elastic body 12 when the elastic body 12 is elastically deformed by being pressed by the head section 15 of the operation member 11. As a result, even when the elastic body 12 is compressed and deformed by being pressed and expands toward the outer periphery side according to the compressed state, the expanded portion can be released to the clearance section 18, whereby the elastic body 12 can be favorably compressed and deformed. As a result, the shaft section 14 of the operation member 11 can be favorably slid.

In this embodiment, the friction reduction section 21 which reduces the frictional resistance of the head section 15 with respect to the slipping sheet 13 is provided in the inner surface of the head section 15 of the operation member 11 opposing the elastic body 12, whereby the frictional resistance of the head section 15 with respect to the slipping sheet 13 can be reduced. That is, this friction reduction section 21 is an annular groove section provided in the inner surface of the head section 15, so that the contact area of the head section 15 with respect to the slipping sheet 13 can be reduced and the frictional resistance of the head section 15 with respect to the slipping sheet 13 can be reduced. By this section as well, the head section 15 can be smoothly and favorably rotated.

Also, in the switch device 8, the plurality of pressure adjustment grooves 20 for keeping a pressure between the outer surface of the first case 2 and the inner surface of the elastic body 12 opposing the outer surface of the first case 2 at the same level as a pressure outside the wristwatch case 2 are provided in a radial shape in the inner surface of the elastic body 12 opposing the outer surface of the first case 2. As a result, the operation member 11 can be prevented from being unintentionally operated by the pressure outside the wristwatch case 1.

That is, in the switch device 8, even though the inner surface of the elastic body 12 arranged between the outer surface of the first case 2 and the inner surface of the head section 15 of the operation member 11 opposing the outer surface of the first case 2 is in elastic contact with the outer surface of the first case 2 by the elastic force of the elastic body 12 generated by the elastic body 12 expanding to a stable shape in a natural state, a fluid such as water or air outside the wristwatch case 1 can be flowed into the plurality of pressure adjustment grooves 20 provided on the inner surface of the elastic body 12 opposing the outer surface of the first case 2.

Accordingly, in the switch device 8, by a fluid such as water or air flowed into the plurality of pressure adjustment grooves 20, a pressure between the outer surface of the first case 2 and the inner surface of the elastic body 12 opposing the outer surface of the first case 2 can be kept at the same level as a pressure outside the wristwatch case 1. As a result of this structure, the elastic body 12 is prevented from being compressed and deformed by pressure such as hydraulic pressure or atmospheric pressure outside the wristwatch case 1, so that the operation member 11 can be reliably and favorably prevented from being unintentionally operated.

Moreover, in the switch device 8, even if a foreign substance such as mud or dust flows into the plurality of pressure adjustment grooves 20 together with a fluid such as water or air outside the wristwatch case 1, the plurality of pressure adjustment grooves 20 are elastically and flexurally deformed when the head section 15 of the operation member 11 is pressed to compress and deform the elastic body 12. As a result, the foreign substance such as mud or dust flowed into the plurality of pressure adjustment grooves 20 can be ejected to the clearance section 18, whereby mud-proofness and dust-proofness can be ensured.

Note that, in the above-described first embodiment, the friction reduction section 21 provided on the inner surface of the head section 15 opposing the slipping sheet 13 interposed between the elastic body 12 and the head section 15 of the operation member 11 is an annular groove section. However, the present invention is not limited thereto. For example, a friction reduction section 23 having a projection shape may be adopted, as with a modification example shown in FIG. 5.

Figure 5:
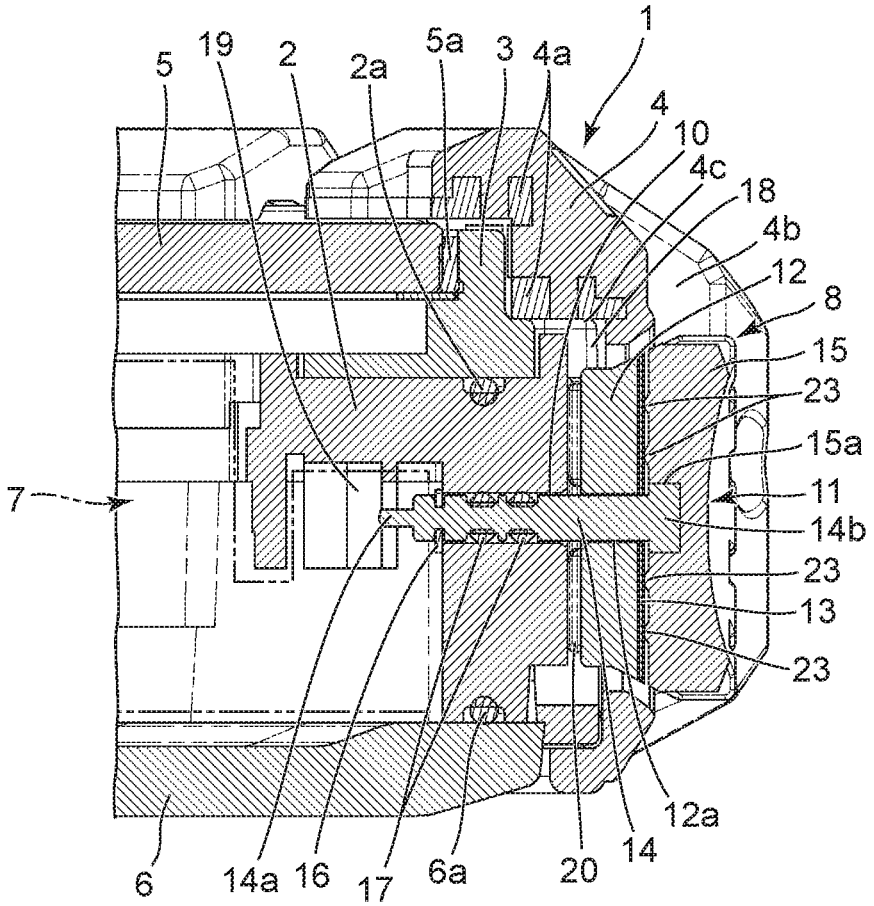
FIG. 5 is an enlarged sectional view showing the main portion of a modification example of the switch device shown in FIG. 2.

More specifically, the friction reduction section 23 in this modification example is a plurality of projection sections provided on the inner surface of the head section 15 opposing the slipping sheet 13, as shown in FIG. 5. These projection sections are formed to have a semi-circular arc shape in cross section, and are concentrically provided centering on the shaft section 14 of the operation member 11, on the inner surface of the head section 15. As a result, this friction reduction section 23 is structured such that the respective leading ends of the plurality of projection sections come in line contact with the slipping sheet 13 and, in this state, slip on the slipping sheet 13 as the head section 15 rotates.

In this switch device 8, the friction reduction section 23 provided on the inner surface of the head section 15 of the operation member 11 can reduce the frictional resistance of the head section 15 with respect to the slipping sheet 13, as in the case of the first embodiment. That is, this friction reduction section 23 is a plurality of projection sections each having a semicircular arc shape in cross section and concentrically provided on the inner surface of the head section 15, so that the contact area of the head section 15 with respect to the slipping sheet 13 can be made significantly smaller as compared to the friction reduction section 21 of the first embodiment. In addition, the frictional resistance of the head section 15 with respect to the slipping sheet 13 can be significantly reduced, so that the head section 15 can be more smoothly and favorably rotated as compared to the first embodiment.

Second Embodiment

Next, a second embodiment where the present invention has been applied in a wristwatch is described with reference to FIG. 6 and FIG. 7. Note that sections that are the same as those in the first embodiment shown in FIG. 1 to FIG. 4A and FIG. 4B are provided with the same reference numerals.

Figure 6:
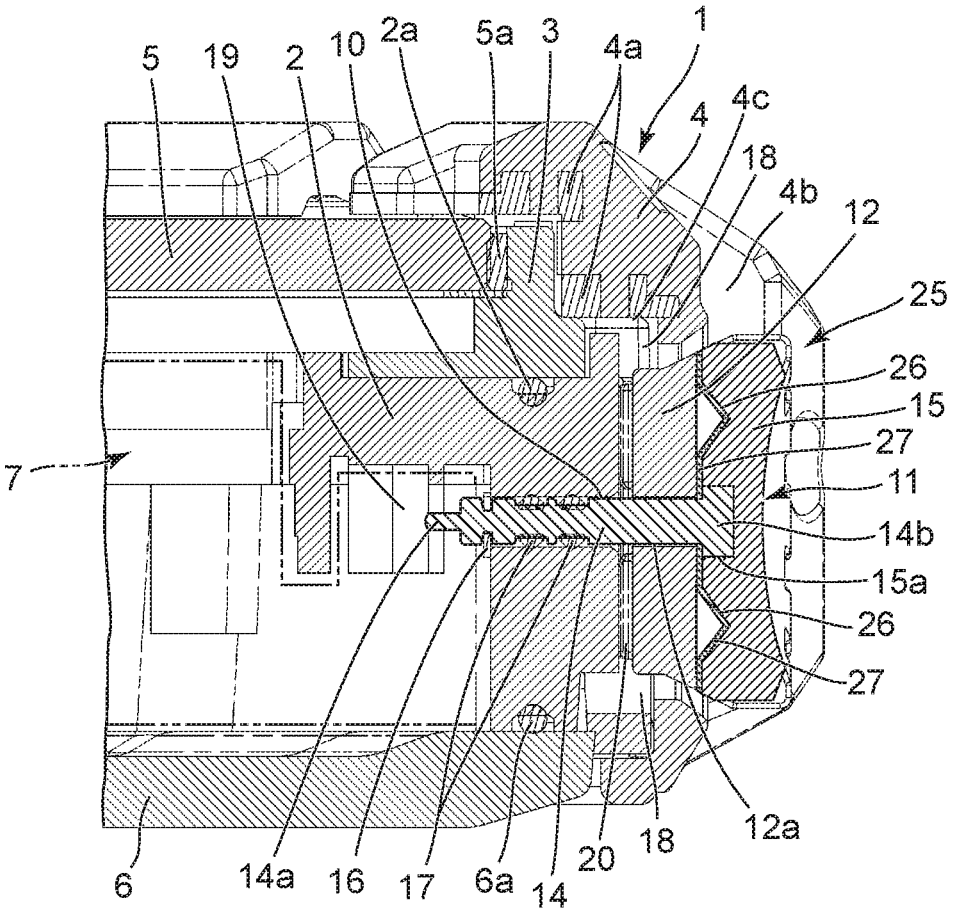
FIG. 6 is an enlarged sectional view showing a switch device in the main portion of a second embodiment where the present invention has been applied in a wristwatch.
Figure 7:
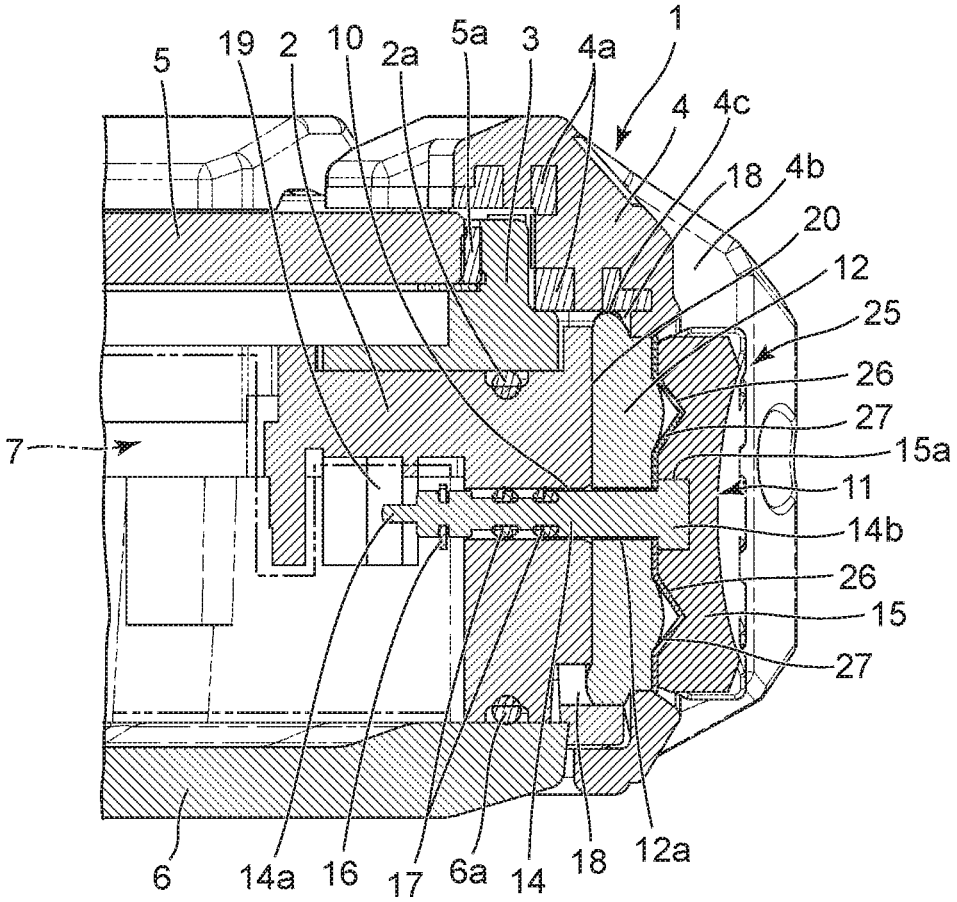
FIG. 7 is an enlarged sectional view of the main portion, in which an operation member has been operated in the switch device shown in FIG. 6.

A switch device 25 in this wristwatch has the same structure as that of the first embodiment except that a friction reduction section 26 and a slipping section 27 are provided on the inner surface of the head section 15 of the operation member 11, as shown in FIG. 6 and FIG. 7.

More specifically, this friction reduction section 26 is a groove having a substantially V shape in cross section which reduces the contact area of the head section 15 of the operation member 11 with respect to the elastic body 12 while providing a space for a portion of the elastic deformation of the elastic body 12, and is provided in an annular shape on the inner surface of the head section 15 opposing the elastic body 12, as shown in FIG. 6 and FIG. 7. That is, this friction reduction section 26 is structured to provide, when the head section 15 presses the elastic body 12 to compress and deform the elastic body 12, a space for a portion of the elastic deformation of the elastic body 12 expanding in the axial direction of the shaft section 14 of the operation member 11.

Also, the slipping section 27 is a surface processing layer having slipperiness and provided on the inner surface of the head section 15 of the operation member 11 opposing the elastic body 12 and the inner surface of the friction reduction section 26 on the inner surface of the head section 15, as shown in FIG. 6 and FIG. 7. That is, this slipping section 27 is a section acquired by the inner surface of the head section 15 and the inner surface of the friction reduction section 26 being subjected to surface processing for slipperiness such as fluorine coating or Teflon (registered trademark) coating.

Next, the operation of the switch device 25 in the wristwatch is described.

When this switch device 25 is in a normal state, the head section 15 of the operation member 11 has been pulled outward from the wristwatch case 1 by the elastic force of the elastic body 12 expanding to a stable shape in a natural state, and the retaining member 16 provided on the small-diameter section 14*a* of the shaft section 14 of the operation member 11 is in contact with the inner peripheral surface of the first case 2, as in the case of the first embodiment.

In this state, as with the first embodiment, the inner surface of the elastic body 12 opposing the outer surface of the first case 2 is in elastic contact with the outer surface of the first case 2, whereby waterproof between the outer surface of the first case 2 and the inner surface of the elastic body 12 is achieved. In addition, the elastic body 12 is in elastic contact with the slipping section 27 that is a surface processing layer provided on the inner surface of the head section 15 without projecting into the friction reduction section 26 in the head section 15 of the operation member 11.

As a result, the head section 15 of the operation member 11 is positioned between the pair of protection projection sections 4*b* on the exterior member 4 by being pressed outward by the elastic force of the elastic body 12. Here, the switch element 19 in the timepiece module 7 is in an off state by the leading end of the small-diameter section 14*a* of the shaft section 14 of the operation member 11, as in the case of the first embodiment.

In this state, when the head section 15 of the operation member 11 arranged between the pair of protection projection sections 4*b* on the exterior member 4 is pressed into the wristwatch case 1 against the elastic force of the elastic body 12, the inner surface of the head section 15 presses and compresses the elastic body 12 together with the slipping section 27 that is a surface processing layer. Here, the elastic body 12 expands toward the outer periphery side according to its compressed state, and the expanded portion is released to the clearance section 18 in the exterior member 4, as in the case of the first embodiment.

Also, here a portion of the outer surface of the elastic body 12 opposing the head section 15 of the operation member 11, that is, a portion of the elastic body 12 corresponding to the friction reduction section 26 in the head section 15 is released to and projects into the friction reduction section 26 in the head section 15 according to the compressed state of the elastic body 12. As a result, the elastic body 12 is favorably compressed and deformed.

Here, as with the first embodiment, the shaft section 14 of the operation member 11 is slid in the axial direction inside the through hole 10 in the first case 2, and the leading end of the small-diameter section 14*a* of the shaft section 14 is pressed into the first case 2 so as to perform a pressing operation on the switch element 19 in the timepiece module 7, whereby the switch element 19 outputs a first switch signal.

Also, when the head section 15 of the operation member 11 is rotated, the shaft section 14 of the operation member 11 is rotated, and the small-diameter section 14*a* of the shaft section 14 is rotated inside the switch element 19 along with the rotation of the shaft section 14, whereby the switch element 19 outputs a second switch signal, as in the case of the first embodiment.

Here, when being rotated while elastically deforming the elastic body 12, the head section 15 of the operation member 11 is rotated while bringing the slipping section 27, which is a surface processing layer, into elastic contact with the elastic body 12. As a result, by the slipping section 27, the head section 15 is smoothly rotated. Also, here, the friction reduction section 26 provided on the inner surface of the head section 15 reduces the frictional resistance of the slipping section 27, which is a surface processing layer provided on the inner surface of the head section 15, to the elastic body 12. By this structure as well, the head section 15 is smoothly rotated.

That is, when the slipping section 27 on the head section 15 of the operation member 11 is rotated while coming in elastic contact with the elastic body 12, a portion of the elastic body 12 projects into the friction reduction section 26 that is a groove section having a substantially V shape in cross section provided on the inner surface of the head section 15. As a result, the contact area and the contact pressure of the slipping section 27, which is a surface processing layer provided on the inner surface of the head section 15, with respect to the elastic body 12 are reduced, and the frictional resistance of the slipping section 27 with respect to the elastic body 12 is reduced. Accordingly, the head section 15 is more smoothly rotated.

In this switch device 25 as well, in the normal state, even when the head section 15 of the operation member 11 has been pulled outward from the wristwatch case 1 by the elastic force of the elastic body 12 expanding to a stable shape in a natural state and the inner surface of the elastic body 12 is in elastic contact with the outer surface of the first case 2, the plurality of pressure adjustment grooves 20 provided in a radial shape in the inner surface of the elastic body 12 opposing the outer surface of the first case 2 prevents the operation member 11 from being unintentionally operated.

That is, in the switch device 25 in the normal state, even when the inner surface of the elastic body 12 is in elastic contact with the outer surface of the first case 2, fluid such as water or air outside the wristwatch case 1 flows into the plurality of pressure adjustment grooves 20 provided in the inner surface of the elastic body 12. Accordingly, by the fluid such as water or air flowed into the plurality of pressure adjustment grooves 20, pressure between the outer surface of the first case 2 and the inner surface of the elastic body 12 can be kept at the same level as the pressure outside the wristwatch case 1. As a result, by the pressure such as hydraulic pressure or atmospheric pressure outside the wristwatch case 1, the elastic body 12 is prevented from being compressed and deformed, so that the operation member 11 is prevented from being unintentionally operated, as in the case of the first embodiment.

Here, even if a foreign substance such as mud or dust flows into the plurality of pressure adjustment grooves 20 together with a fluid such as water or air, the plurality of pressure adjustment grooves 20 are elastically and flexurally deformed when the head section 15 of the operation member 11 is pressed and the elastic body 12 is compressed and deformed, so that the foreign substance such as mud or dust flowed into the plurality of pressure adjustment grooves 20 together with the fluid such as water or air can be ejected to the clearance section 18, and mud-proofness and dust-proofness can be achieved, as in the case of the first embodiment.

As described above, the switch device 25 in the wristwatch has a function and an effect similar to those of the first embodiment. In addition, on the inner surface of the head section 15 of the operation member 11 opposing the elastic body 12, the friction reduction section 26 is provided which reduces the frictional resistance of the head section 15 with respect to the elastic body 12 while providing a space for a portion of the elastic deformation of the elastic body 12. By this friction reduction section 26, the frictional resistance of the head section 15 with respect to the slipping sheet 12 can be reduced.

That is, since this friction reduction section 26 is a groove section having a substantially V shape in cross section and provided on the inner surface of the head section 15, when the head section 15 presses the elastic body 12 to compress and deform the elastic body 12, a portion of the outer surface of the elastic body 12 can be projected into the friction reduction section 26 according to the compressed state of the elastic body 12, whereby the contact area and the contact pressure of the head section 15 with respect to the elastic body 12 can be reduced. As a result, the frictional resistance of the head section 15 to the elastic body 12 can be reduced, so that the head section 15 can be smoothly and favorably rotated.

Also, this switch device 25 includes the slipping section 27 that is a surface processing layer having slipperiness and provided on the inner surface of the head section 15 of the operation member 11 opposing the elastic body 12 and the inner surface of the friction reduction section 26 provided on the inner surface of the head section 15. By this slipping section 27 that is a surface processing layer, the head section 15 can be smoothly rotated with respect to the elastic body 12.

That is, in this switch device 25, even though a portion of the outer surface of the elastic body 12 opposing the head section 15 projects into the friction reduction section 26 according to the compressed state of the elastic body 12 when the head section 15 presses the elastic body 12 to compress and deform the elastic body 12, this projected portion can be brought into contact with the slipping section 27 in the friction reduction section 26, so that the head section 15 can be smoothly rotated.

Note that, in the above-described second embodiment, the slipping section 27 that is a surface processing layer is provided on the inner surface of the head section 15 of the operation member 11 opposing the elastic body 12. However, the present invention is not limited thereto, and a structure may be adopted in which a slipping section that is a surface processing layer is provided on the outer surface of the elastic body 12 opposing the head section 15. Alternatively, a structure may be adopted in which slipping sections that are surface processing layers are provided on both the inner surface of the head section 15 and the outer surface of the elastic body 12.

Also, in the above-described first and second embodiments and the modification examples, the present invention has been applied in a wristwatch. However, the present invention is not necessarily required to be applied in a wristwatch. For example, the present invention is applicable to various types of timepieces such as a travel watch, an alarm clock, a table clock, and a wall clock. Also, the present invention is not necessarily required to be applied to a timepiece, and is also applicable to electronic devices such as a mobile phone and a personal digital assistant.

While the present invention has been described with reference to the preferred embodiments, it is intended that the invention be not limited by any of the details of the description therein but includes all the embodiments which fall within the scope of the appended claims.

What is claimed is:

1. A switch device comprising:
a case defining a through hole;
an operation member comprising:
a shaft provided in the through hole of the case along an axis; and
a head provided on an outer end of the shaft and arranged outside the case;
an elastic body arranged between a surface of the case and a surface of the head opposing the surface of the case,
wherein the elastic body is configured to be compressed by the head towards the case in an inward direction along the axis and to force the head away from the case in an outward direction along the axis by an elastic force of the elastic body generated by expanding to a stable shape in a natural state; and
a slipping layer arranged between the head and the elastic body along the axis,
wherein the slipping layer is configured such that as the head is rotated in a rotational direction about the axis while compressing the elastic body, the slipping layer reduces frictional resistance in the rotational direction between the elastic body and the head.

2. The switch device according to claim 1,
wherein the shaft is configured to:
slide along the axis in the inward direction as the head is moved towards the elastic body and along the outward direction as the head is moved away from the elastic body; and
rotate in the rotational direction about the axis as the head is rotated about the axis.

3. The switch device according to claim 1,
wherein the slipping layer comprises a slipping sheet interposed between the elastic body and the head.

4. The switch device according to claim 1, further comprising:
an exterior member provided around an outer periphery of the case,
wherein the exterior member defines a clearance for elastic deformation of the elastic body as the elastic body is compressed by the head towards the case.

5. The switch device according to claim 1,
wherein a portion of a surface of the elastic body opposing the surface of the case defines a pressure adjustment groove, and
wherein the pressure adjustment groove is configured to keep a pressure between the surface of the case and the surface of the elastic body at a same level as a pressure outside the case.

6. The switch device according to claim 1,
wherein a portion of the surface of the head opposing the surface of the case defines a groove, and
wherein the groove is configured to reduce the frictional resistance in the rotational direction between the elastic body and the head.

7. The switch device according to claim 1,
wherein a portion of the surface of the head opposing the surface of the case defines a groove, wherein the groove is configured to reduce the frictional resistance in the rotational direction between the elastic body and the head, and wherein the groove is configured to fit a portion of the elastic body that is deformed as the elastic body is compressed by the head towards the case in the inward direction.

8. The switch device according to claim 7, wherein the slipping layer is a surface processing layer having slipperiness, and wherein the slipping layer is provided on the surface of the head opposing the surface of the case and including the portion of the surface of the head defining the groove.

9. A timepiece comprising the switch device according to claim 1.

10. The switch device according to claim 3, wherein the slipping sheet comprises one of:

a synthetic resin comprising fluorine-based resin or polyamide-based resin; and a plate having the synthetic resin provided on a surface of the plate.

11. The switch device according to claim 1, wherein the elastic body defines an insertion hole through which the shaft of the operation member is inserted.

12. The switch device according to claim 1, wherein the elastic body defines an insertion hole through which the shaft of the operation member is inserted, wherein portions of a surface of the elastic body opposing the surface of the case define a plurality of pressure adjustment grooves provided in a radial shape from the insertion hole, and wherein the pressure adjustment grooves are configured to keep a pressure between the surface of the case and the surface of the elastic body at a same level as a pressure outside the case.

13. The switch device according to claim 1, wherein the slipping layer is a surface processing layer having slipperiness, and wherein the slipping layer is provided on the surface of the head opposing the surface of the case.

* * * * *